US007364412B2

(12) United States Patent
Kugelev et al.

(10) Patent No.: US 7,364,412 B2
(45) Date of Patent: Apr. 29, 2008

(54) SYSTEM, METHOD, AND APPARATUS FOR VALVE STOP ASSEMBLY IN A RECIPROCATING PUMP

(75) Inventors: Vladimir Kugelev, Arlington, TX (US); Mark D. Matzner, Burleson, TX (US)

(73) Assignee: S.P.M. Flow Control, Inc., Fort Worth, TX (US)

( * ) Notice: Subject to any disclaimer, the term of this patent is extended or adjusted under 35 U.S.C. 154(b) by 539 days.

(21) Appl. No.: 10/913,221

(22) Filed: Aug. 6, 2004

(65) Prior Publication Data

US 2006/0029502 A1 Feb. 9, 2006

(51) Int. Cl.
*F04B 39/10* (2006.01)

(52) U.S. Cl. ..... 417/454; 417/568; 417/571

(58) Field of Classification Search ..... 417/454, 417/568, 571, 536, 559, 539
See application file for complete search history.

(56) References Cited

U.S. PATENT DOCUMENTS 2,776,701 A * 1/1957 Denis ..... 297/6
4,861,241 A * 8/1989 Gamboa et al. ..... 417/454
6,910,871 B1 6/2005 Blume
7,186,097 B1 * 3/2007 Blume ..... 417/454

FOREIGN PATENT DOCUMENTS

GB 1449280 A 9/1976

* cited by examiner

*Primary Examiner*—Devon C. Kramer
*Assistant Examiner*—Peter J Bertheaud
(74) *Attorney, Agent, or Firm*—Bracewell & Giuliani LLP

(57) ABSTRACT

A reciprocating pump assembly has a pump housing with a crankshaft. A plunger is connected to the crankshaft for pumping a fluid through a cylinder. The cylinder has a fluid inlet port and an opening that provides access to the cylinder. A suction cover is mounted in the opening and has a hub that is coaxial with an axis of the suction cover. A suction valve stop is mounted adjacent one of the fluid ports and has a spring retainer. A column extends from the spring retainer, and a bushing is mounted to the spring retainer for engaging and being retained by the hub of the suction cover. The suction cover guides the suction valve stop in operation and, when the suction cover is removed from the opening, the suction valve stop is removable.

18 Claims, 6 Drawing Sheets

SYSTEM, METHOD, AND APPARATUS FOR VALVE STOP ASSEMBLY IN A RECIPROCATING PUMP

BACKGROUND OF THE INVENTION

1. Technical Field

The present invention relates in general to reciprocating pumps and, in particular, to an improved system, method, and apparatus for a suction valve stop assembly in a reciprocating pump.

2. Description of the Related Art

In oil field operations, reciprocating pumps are often used for various purposes. Some reciprocating pumps, generally known as "service pumps," are typically used for operations such as cementing, acidizing, or fracing a well. Typically, these service pumps run for relatively short periods of time, but they operate on a frequent basis. Often they are mounted to a truck or a skid for transport to various well sites. A pump might operate several times a week. In many applications, several pumps are connected in parallel to a single flow line.

As shown in FIG. 10, a reciprocating pump 101 typically has a plunger 103 for pumping a fluid through a cylinder 105. The cylinder has a fluid inlet 107 and a fluid outlet 109. An opening 111 in the pump 101 provides access to an interior of the cylinder 105. The opening 111 is sealed with a suction cover 115 and nut 116 that form a portion of a suction cover assembly 113. Suction cover assembly 113 also structurally supports a valve spring retainer 117. The valve spring retainer 117 seats in fluid inlet 107 and retains a spring 119 of the inlet valve 121. The valve spring retainer 117 also engages a hub 123. The hub 123 is eccentric or offset with respect to a central axis 125 of suction cover 115). Hub 123 protrudes from suction cover 115 to restrain valve spring retainer 117 during operation.

Importantly, suction cover 115 utilizes a set screw 122 that engages a threaded hole in cylinder 105, which thereby prevents rotation of suction cover 115 during operation. It is the eccentric positioning of the hub 123 that necessitates set screw 122 due to the torque applied by the valve spring retainer 117.

Suction cover assembly 113 can be disassembled and reassembled to provide access to and reseal the cylinder 105, respectively. However, the diametral clearance between suction cover 115 and valve spring retainer 117 (approximately 0.030") is so tight that it is very difficult to realign and reseat these components with respect to the eccentric hub 123, which must be carefully repositioned to properly make-up with and support the valve spring retainer 117.

Since the clearance is tight, suction cover 115 not only guides valve spring retainer 117, but also supports the valve stop. Forces from fluid flow and spring 119 translate to the suction cover 115, and promote untimely failure of the suction cover 115 and cylinder 105. That tendency increases with time as cylinder 105 and valve spring retainer 117 engage and wear on each other due to the tight clearance. In addition, it is very difficult to align the eccentric hub 123 to valve spring retainer 117, and the set screw 122 to the hole in the cylinder 105 at the same time. Thus, an improved design for facilitating engagement between the various components of suction cover assemblies is needed.

SUMMARY OF THE INVENTION

One embodiment of a system, method, and apparatus for a reciprocating pump assembly includes a pump housing that houses a crankshaft. A plurality of plungers are mechanically connected to the crankshaft for pumping a fluid through a plurality of cylinders or plunger chambers. Each of the cylinders has a fluid inlet port and a fluid outlet port.

The pump also has an opening for providing access to the cylinder. A suction cover is mounted in the opening and has a concentric hub protruding from the suction cover into the cylinder. The hub is coaxial with an axis of the opening and the suction cover. A suction valve stop is mounted adjacent one of the fluid ports and has a spring retainer for retaining a spring relative to the fluid port. A column extends from the spring retainer, and a bushing is mounted to the spring retainer for engaging and being retained by the coaxial hub of the suction cover. The suction cover guides the suction valve stop in an operational position and, when the suction cover is removed from the opening, the suction valve stop is movable to a non-operational position.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
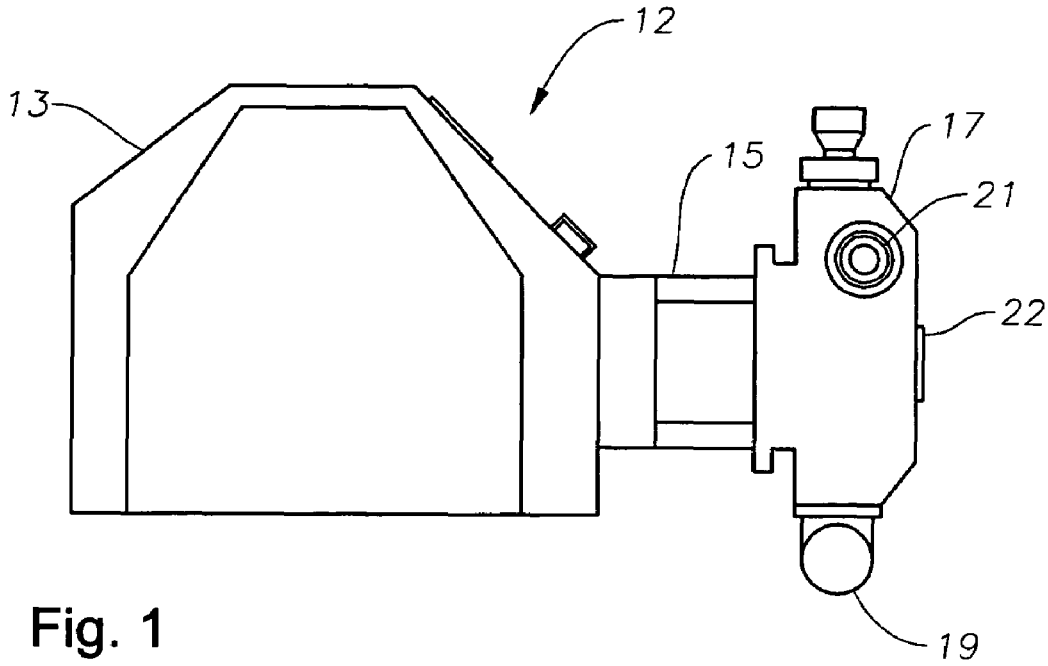
FIG. 1 is an elevational view of a reciprocating pump assembly constructed in accordance with the present invention.
Figure 3:
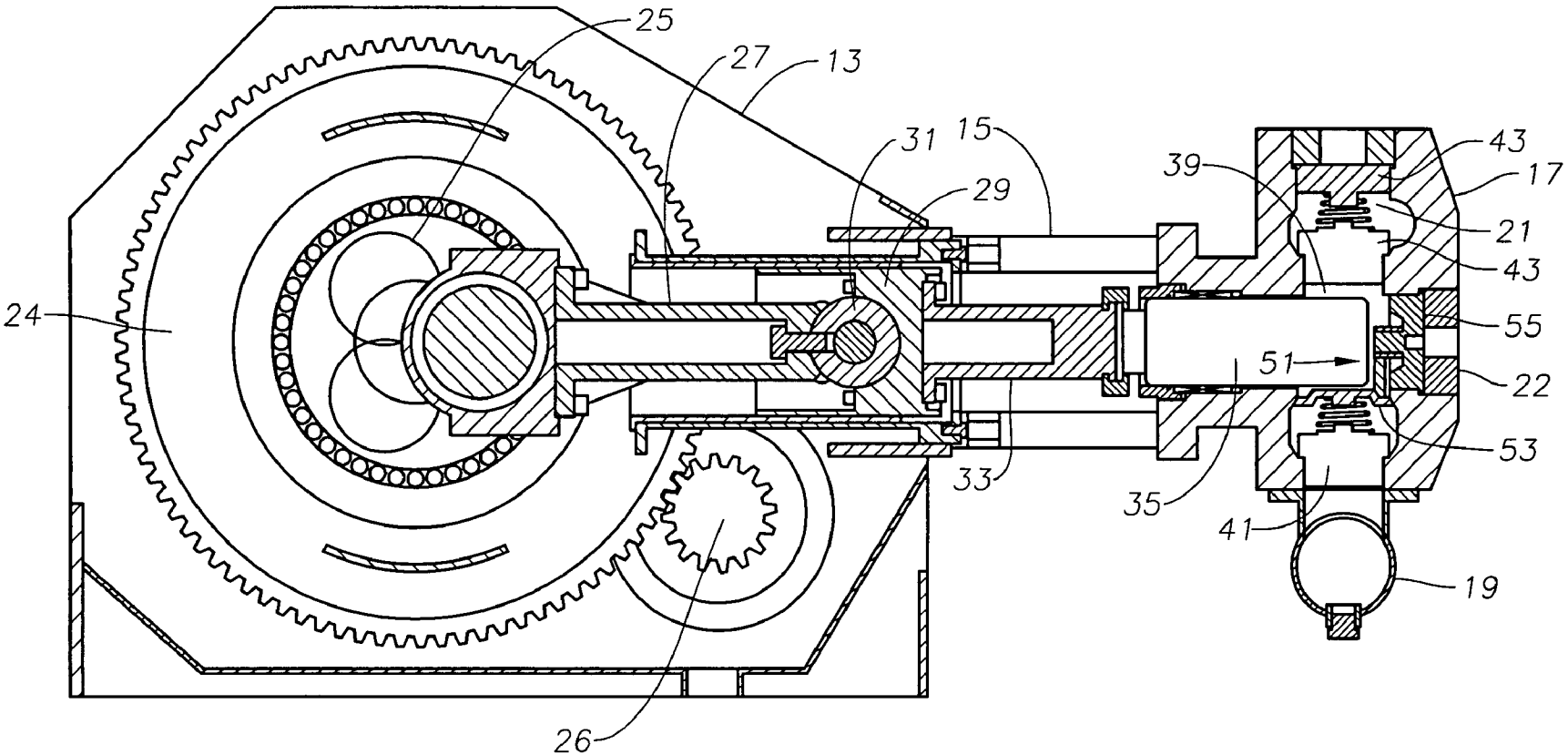
FIG. 3 is a sectional view of a portion of the pump assembly shown in FIG. 1.
Figure 4:
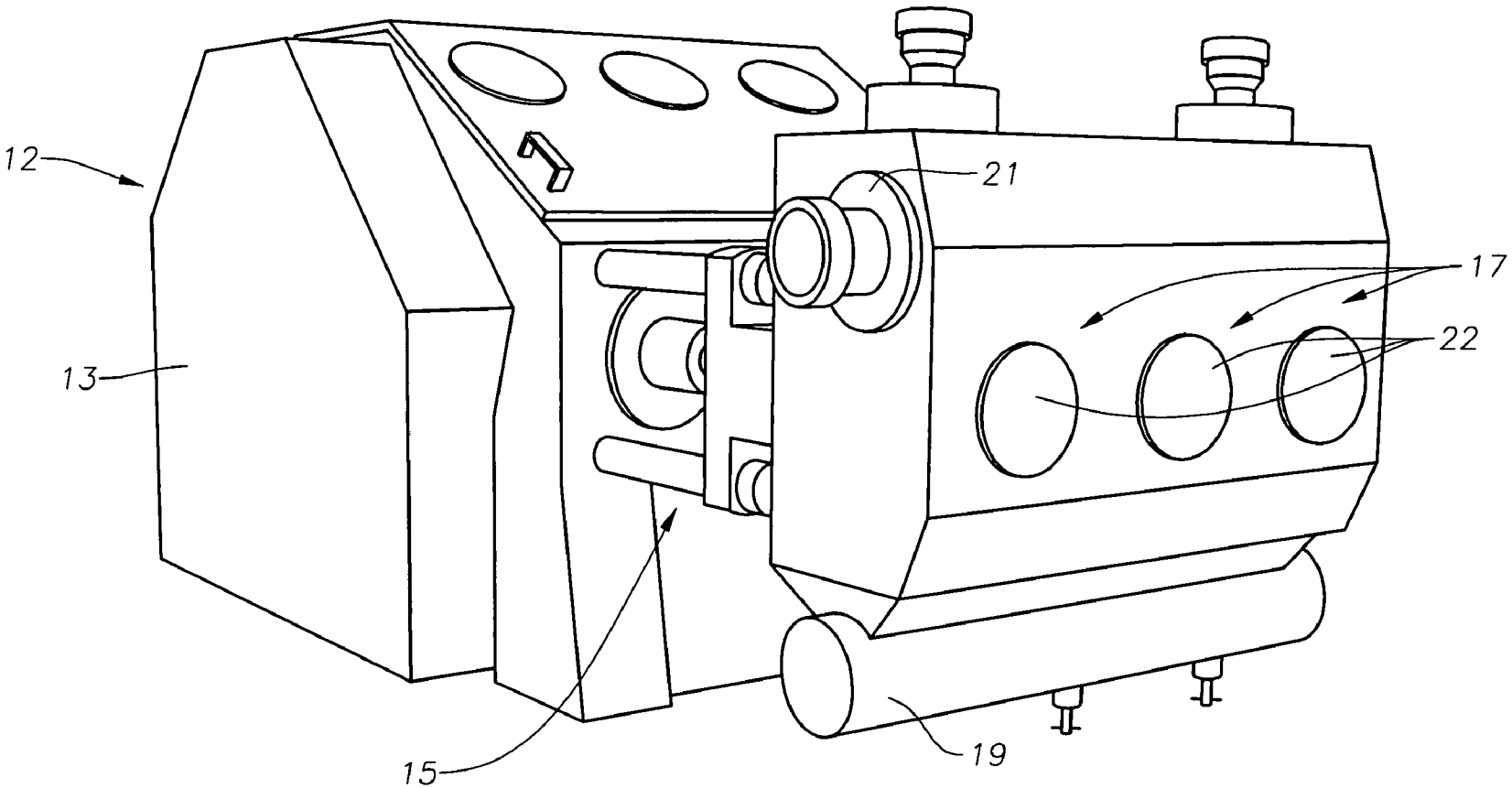
FIG. 4 is a perspective view of the reciprocating pump assembly shown in FIG. 1.

Referring to FIGS. 1 and 3, reciprocating pump assembly or pump 12 includes a crankshaft housing 13 that comprises a majority of the outer surface of reciprocating pump 12. A plunger or plunger rod housing 15 attaches to a side of crankshaft housing 13 and extends to a set of cylinders 17. Each cylinder 17 typically includes a fluid inlet 19 and a fluid outlet 21. As best shown in FIG. 3, a suction cover plate 22 connects to an end of each cylinder 17 opposite the plunger rod housing 15. While pump 12 is shown in FIG. 4 as freestanding on the ground, pump 12 can easily be mounted to a trailer that can be towed between operational sites, or to a skid such as for offshore operations. Accordingly a pump assembly may include a pump 12 mounted directly to the ground or a support structure, a skid, a trailer, etc.

Figure 2:
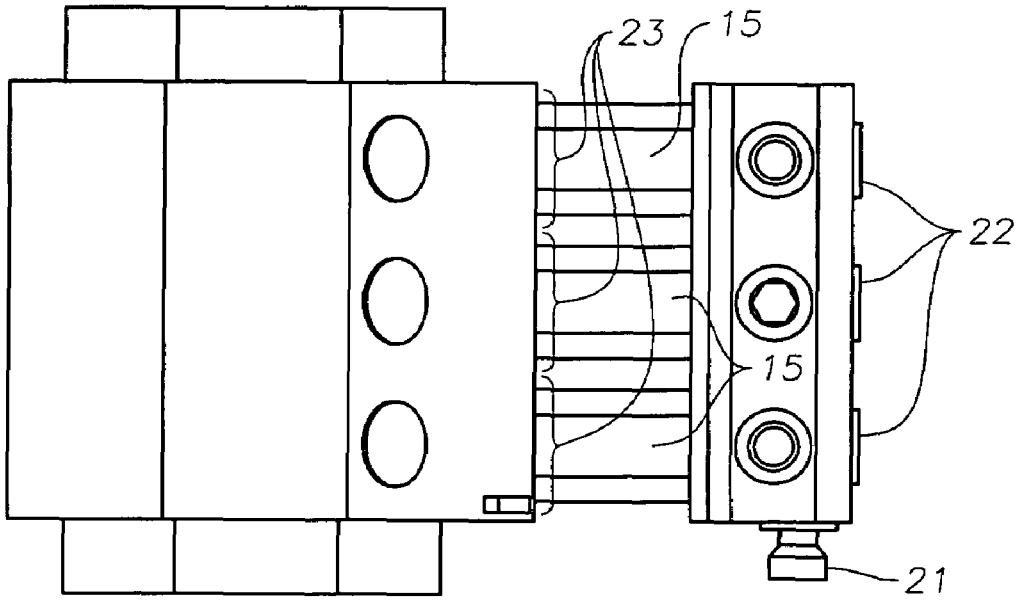
FIG. 2 is a top plan schematic view of the reciprocating pump assembly shown in FIG. 1.

Referring to FIG. 2, plunger rod housing 15 is segmented into three portions, and each portion comprises a plunger throw 23. Reciprocating pump 12 (as shown in FIG. 2) has three plunger throws 23, which is commonly know as a triplex, but could also be segmented for five plunger throws 23, which is commonly known as a quintuplex pump. The present description is directed to a triplex pump, but as will be readily apparent to those skilled in the art, the features and aspects described are easily applicable for a quintuplex pump or still other types of pumps. Each plunger throw 23 houses a plunger rod 33 (FIG. 3) extending to cylinder 17. As shown in FIG. 2, each plunger throw 23 extends in the same longitudinal direction from crankshaft housing 13.

Again referring to FIG. 3, a portion of reciprocating pump 12 housed within crankshaft housing 13 is shown. Crankshaft housing 13 houses a crankshaft 25, which is typically mechanically connected to a motor (not shown). The motor rotates crankshaft 25 in order to drive reciprocating pump 12. In one embodiment, crankshaft 25 is cammed so that fluid is pumped from each cylinder 17 at alternating times. As is readily appreciable by those skilled in the art, alternating the cycles of pumping fluid from each of cylinders 17 helps minimize the primary, secondary, and tertiary (et al.) forces associated with reciprocating pump 12.

In one embodiment, a gear 24 is mechanically connected to crankshaft 25 and is rotated by the motor through gears 26 and 24. A connector rod 27 connects to a crosshead 29 through a crosshead pin 31, which holds connector rod 27 longitudinally relative to crosshead 29. Connector rod 27 pivots about crosshead pin 31 as crankshaft 25 rotates with the other end of connector rod 27. A plunger rod 33 extends from crosshead 29 in a longitudinally opposite direction from crankshaft 25. Connector rod 27 and crosshead 29 convert rotational movement of crankshaft 25 into longitudinal movement of plunger rod 33.

A plunger 35 is connected to plunger rod 33 for pumping the fluid passing through cylinder 17. Cylinder 17 connects to the end of plunger rod housing 15 extending away from crankshaft housing 13 (FIG. 1). Cylinder 17 includes an interior or cylinder chamber 39, which is where plunger 35 compresses the fluid being pumped by reciprocating pump 12. Cylinder 17 also typically includes an inlet valve 41 and an outlet valve 43. Valves 41 and 43 are usually spring-loaded valves and are actuated by a predetermined differential pressure. Inlet valve 41 actuates to control fluid flow through fluid inlet 19 into cylinder chamber 39, and outlet valve 43 actuates to control fluid flow through fluid outlet 21 from cylinder chamber 39.

Plunger 35 reciprocates, or moves longitudinally toward and away from cylinder 17, as crankshaft 25 rotates. As plunger 35 moves longitudinally away from cylinder chamber 39, the pressure of the fluid inside chamber 39 decreases creating a differential pressure across inlet valve 41, which actuates valve 41 and allows the fluid to enter cylinder chamber 39 from fluid inlet 19. The fluid being pumped enters cylinder chamber 39 as plunger 35 continues to move longitudinally away from cylinder 17 until the pressure difference between the fluid inside chamber 39 and the fluid in fluid inlet 19 is small enough for inlet valve 41 to actuate to its closed position. As plunger 35 begins to move longitudinally towards cylinder 17, the pressure on the fluid inside of cylinder chamber 39 begins to increase. Fluid pressure inside cylinder chamber 39 continues to increase as plunger 35 approaches cylinder 17 until the differential pressure across outlet valve 43 is large enough to actuate valve 43 and allow the fluid to exit cylinder 17 through fluid outlet 21. In one embodiment, fluid is only pumped across one side of plunger 35, therefore reciprocating pump 12 is a single-acting reciprocating pump.

Referring now to FIGS. 3 through 9, one embodiment of a suction valve stop assembly 51 for each cylinder 17 of reciprocating pump 12 is shown. When cover plate 22 is removed, suction valve stop assembly 51 is designed to provide quicker and easier access to the inlet valve 41 than prior art designs. Moreover, suction valve stop assembly 51 is much more readily reinstalled in cylinder 17 and accommodates a much larger range of clearance because of its unique design.

Figure 5:
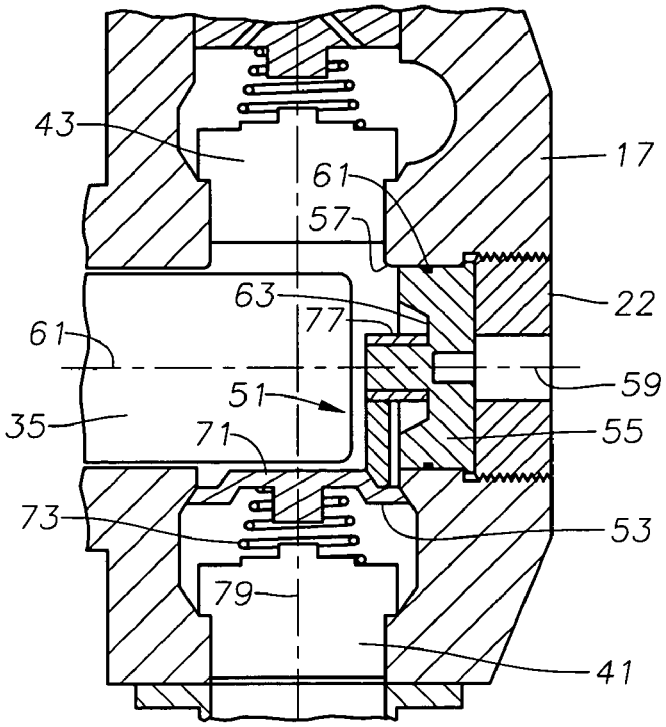
FIG. 5 is an enlarged sectional view of valve stop assembly for the reciprocating pump assembly shown in FIG. 1.

As best shown in FIG. 5, the suction valve stop assembly 51 comprises two primary components: a suction valve stop 53 and a suction cover 55. The suction cover 55 is generally cylindrical in shape and is designed to be mounted in an opening 57 in the cylinder 17 that provides access to the interior of the cylinder 17. The opening 57 has an axis 59 that, in the embodiment shown, is concentric with the axis 59 of the plunger 35 and cylinder 17. The suction cover 55 seals opening 57 with a seal 61 that is mounted in a recess 64 (FIG. 8) that circumscribes an exterior of the suction cover 55. Suction cover 55 is retained in opening 57 by cover plate 22, which threading engages opening 57 in the embodiment shown.

Figure 10:
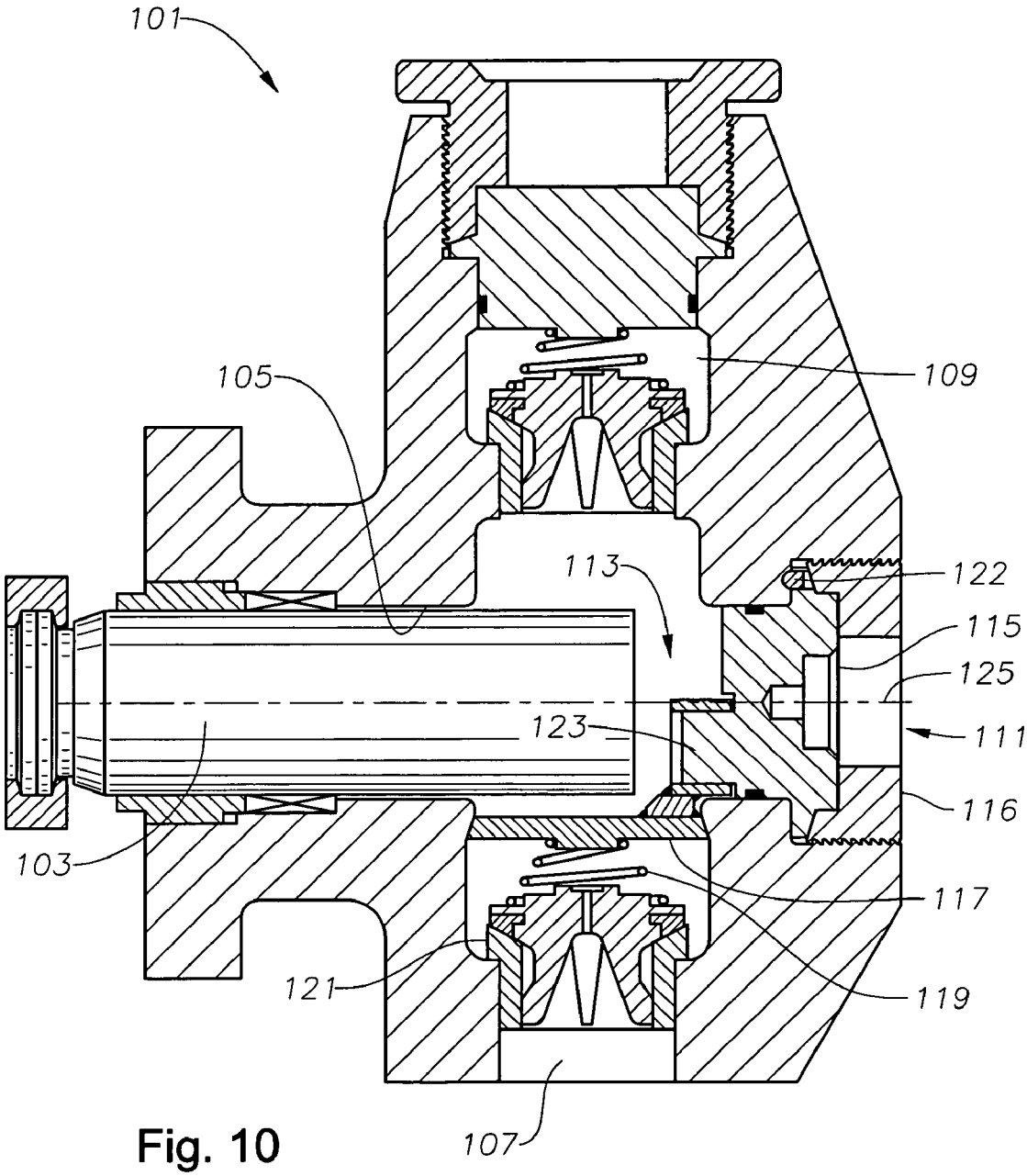
Fig. 10 (Prior Art)
FIG. 10 is a sectional view of a conventional valve stop assembly.

Referring again to FIG. 8, a central recess 63 (e.g., axially symmetric) is formed on one side of a main body of the suction cover 55. A hub 65 protrudes from the central recess 63 into the cylinder 17. In one embodiment, the hub 65 is cylindrical and coaxial with the axis 59 of the suction cover 55 and opening 57. As a result, the suction valve stop 53 exerts no torque on the suction cover 55, such that the suction cover 55 is void of anti-rotation devices (see, e.g., set screw 122 in prior art FIG. 10).

Figure 7:
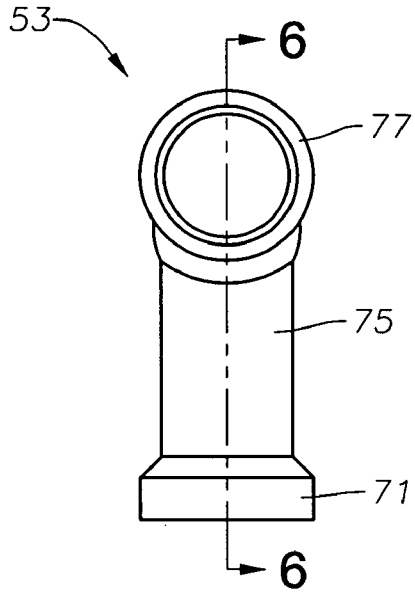
FIG. 7 is an end view of the suction valve stop of FIG. 6.
Figure 6:
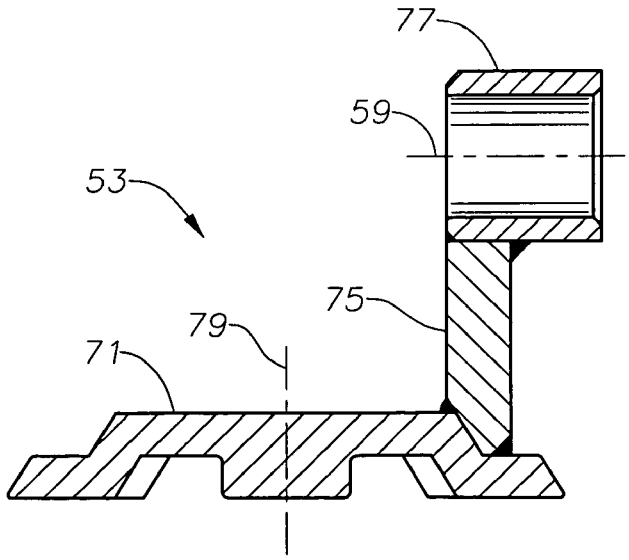
FIG. 6 is a sectional side view of a suction valve stop for the valve stop assembly of FIG. 5, and is taken along the line 6-6 of FIG. 7.
Figure 8:
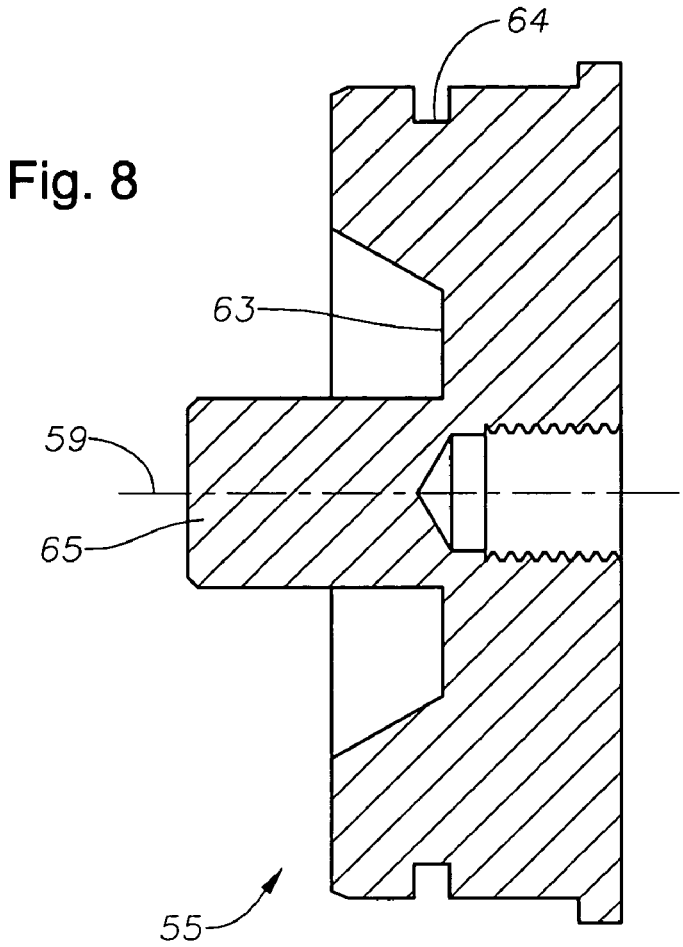
FIG. 8 is a sectional side view of a suction cover for the valve stop assembly of FIG. 5, and is taken along the line 8-8 of FIG. 9.
Figure 9:
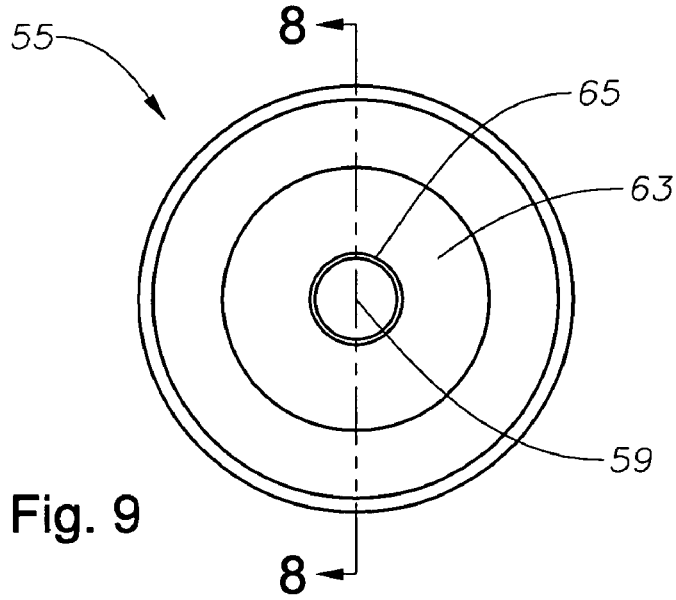
FIG. 9 is an end view of the suction cover of FIG. 8.

As shown in FIG. 5, the suction valve stop 53 is mounted adjacent to one of the fluid ports (e.g., fluid inlet 19 in FIG. 3) and has a spring retainer 71 for retaining a spring 73 relative to the fluid port. The spring retainer 71 engages the tapered upper end of fluid port. Referring now to FIGS. 6 and 7, a column 75 extends from the spring retainer 71, and a bushing 77 is mounted to the column 75 for engaging and being retained by the hub 65 of the suction cover 55. In this way, the suction cover 55 merely guides the suction valve stop 53 in an operational position (FIGS. 3 and 5). When the suction cover 55 is removed from the opening 57, the suction valve stop 53 is movable to a non-operational position (e.g., out of the fluid port and through opening 57 to an exterior of the pump 12.

In one embodiment, the spring retainer 71 has an axis 79 (FIG. 6). The column 75 extends in the axial direction away from the spring retainer 71, but is laterally offset from the axis 79 of the spring retainer 71 such that the column 75 is eccentric relative to axis 79. The bushing 77 also has an axis 59, but (in the embodiment shown) it is oriented perpendicular to axis 79 of the spring retainer 71 and is concentric with the axis 59 of the suction cover 55 and opening 57. In this way, the column 75 of the suction valve stop 53 is perpendicular to the axis 59 of the opening 57 and parallel to the axis 79 of the fluid inlet 19. Moreover (in one embodiment), the axis 59 of the opening 57 is coaxial with an axis 61 (FIG. 5) of the cylinder 17.

The present invention provides the suction valve stop assembly 51 with a large amount of diametral clearance compared to the prior art. For example, in some embodiments the present invention has approximately 0.025" more clearance than the prior art (i.e., a total of about 0.060"). This example is merely illustrative and is no way is meant to limit the scope of the present invention. This relatively large amount of diametral clearance is accommodated between the hub 65 of the suction cover 55 and the bushing 77 of the suction valve stop 53. However, the clearance is sufficient to maintain engagement between suction cover 55 and suction valve stop 53 during operation. The range of diametral clearance between the suction cover 55 and the suction valve stop 53 compensates for wear between the cylinder 17 and the suction valve stop 53, and maintains engagement between the suction cover 55 and the suction valve stop 53 during operation, such that the suction cover 55 continues to merely guide but does not structurally support or cause wear on the suction valve stop 53 or cylinder 17.

While the invention has been shown or described in only some of its forms, it should be apparent to those skilled in the art that it is not so limited, but is susceptible to various changes without departing from the scope of the invention.

What is claimed is:

1. A reciprocating pump assembly, comprising:

a pump housing that houses a crankshaft;

a plunger mechanically connected to the crankshaft for pumping a fluid through a cylinder, the cylinder having fluid ports for ingress and egress of fluid, the plunger being movable in forward and rearward directions along a pathway;

an opening in the cylinder for providing access to the cylinder, the opening having an axis;

a suction cover mounted in and closing the opening and having an axis and a hub having an axis that is coaxial with the axis of the suction cover;

a suction valve stop mounted adjacent one of the fluid ports and below the pathway of the plunger; and a column having a lower end portion joined to a forward edge of the valve stop and an upper end portion that slides into concentric engagement with the hub.

2. The reciprocating pump assembly of claim 1, wherein the column has an axis that is perpendicular to the axis of the suction cover.

3. The reciprocating pump assembly of claim 1, wherein the column extends generally parallel with an axis of the suction valve stop.

4. The reciprocating pump assembly of claim 1, wherein the hub protrudes from a central recess formed in a body of the suction cover, the central recess being axially recessed in the suction cover such that the hub coaxially protrudes from the suction cover and the central recess.

5. The reciprocating pump assembly of claim 1, wherein the axis of the suction cover is concentric with the axis of the plunger.

6. The reciprocating pump assembly of claim 1, wherein the upper end portion of the column comprises a bushing.

7. The reciprocating pump assembly of claim 1, wherein the hub is cylindrical and has an outer diameter smaller than the opening in the cylinder.

8. In a reciprocating pump assembly having a pump housing that houses a crankshaft, a plunger connected to the crankshaft for pumping a fluid through a cylinder, the cylinder having fluid ports for ingress and egress of fluid, and an opening in the cylinder for providing access to the cylinder, the opening having an axis, the improvement comprising:

a suction cover mounted in the opening and having an axis and a cylindrical hub protruding therefrom into the cylinder, the cylindrical hub being coaxial with the axes of the opening and the suction cover; and a suction valve stop mounted adjacent one of the fluid ports and having a spring retainer for retaining a spring relative to said one of the fluid ports, a column extending from the spring retainer, and a cylindrical bushing mounted to the column for engaging and being retained by the cylindrical hub of the suction cover, such that the suction cover guides the suction valve stop in an operational position and, when the suction cover is removed from the opening, the suction valve stop is movable to non-operational position.

9. The reciprocating pump assembly of claim 8, wherein the spring retainer has an axis, the colunm extends axially from the spring retainer but is laterally offset from the axis of the spring retainer such that the column is eccentric relative to the axis of the spring retainer and perpendicular to the axis of the suction cover, and the cylindrical bushing has an axis that is oriented perpendicular to the axis of the spring retainer and concentric with the axis of the opening.

10. The reciprocating pump assembly of claim 8, wherein the axis of the opening is coaxial with an axis of the cylinder.

11. The reciprocating pump assembly of claim 8, wherein a clearance between the suction cover and the suction valve stop compensates for wear between the cylinder and the suction valve stop, and maintains engagement between the suction cover and the suction valve stop during operation, such that the suction cover continues to guide the suction valve stop.

12. The reciprocating pump assembly of claim 8, wherein the cylindrical hub protrudes from a central recess formed in a body of the suction cover.

13. The reciprocating pump assembly of claim 8, wherein the column of the suction valve stop is perpendicular to the axis of the opening and parallel to an axis of to said one of the fluid ports.

14. The reciprocating pump assembly of claim 8, wherein the suction valve stop exerts no torque on the suction cover, such that the suction cover is void of anti-rotation devices.

15. A reciprocating pump assembly, comprising:

a pump housing that houses a crankshaft;

a plunger mechanically connected to the crankshaft for pumping a fluid through a cylinder, the cylinder having an axis and fluid ports for ingress and egress of fluid;

an opening in the cylinder for providing access to the cylinder, the opening having an axis that is coaxial with the axis of the cylinder;

a suction cover mounted coaxially in the opening and having an axial central recess, a cylindrical hub protruding from the axial central recess into the cylinder, the cylindrical hub being coaxial with the axis of the opening;

a suction valve stop mounted adjacent the fluid port for ingress and having a spring retainer for retaining a spring relative to the fluid port for ingress, a column extending from the spring retainer, and a cylindrical bushing mounted to the column for engaging and being retained by the cylindrical hub of the suction cover, such that the suction cover guides the suction valve stop in an operational position and, when the suction cover is removed from the opening, the suction valve stop is movable to non-operational position; and wherein the suction valve stop exerts no torque on the suction cover, such that the suction cover is void of anti-rotation devices.

16. The reciprocating pump assembly of claim 15, wherein the spring retainer has an axis, the column extends axially from the spring retainer but is laterally offset from the axis of the spring retainer such that the column is eccentric relative to the axis of the spring retainer, and the cylindrical bushing has an axis that is oriented perpendicular to the axis of the spring retainer and coaxial with the axis of the opening.

17. The reciprocating pump assembly of claim 15, wherein a clearance between the suction cover and the suction valve stop compensates for wear between the cylinder and the suction valve stop, and maintains engagement between the suction cover and the suction valve stop during operation, such that the suction cover continues to guide the suction valve stop.

18. The reciprocating pump assembly of claim 15, wherein the column of the suction valve stop is perpendicular to the axis of the opening and parallel to an axis of the fluid ports.

* * * * *